United States Patent [19]

Nilsson

[11] 4,086,672

[45] May 2, 1978

[54] LIFTING DEVICE

[76] Inventor: Lars Agne Nilsson, Middelfartsvagen 9, 57200 Oskarshamn, Sweden

[21] Appl. No.: 708,772

[22] Filed: Jul. 26, 1976

[30] Foreign Application Priority Data

Aug. 7, 1975 Sweden ..... 7508892

[51] Int. Cl.[2] ..... A61G 1/02

[52] U.S. Cl. ..... 5/81 R; 5/89

[58] Field of Search ..... 5/81, 83, 84–89; 214/1

[56] References Cited

U.S. PATENT DOCUMENTS

| | | | |
|---|---|---|---|
| 2,125,546 | 8/1938 | Corr | 5/89 |
| 2,187,198 | 1/1940 | Fields | 5/89 |
| 2,975,434 | 3/1961 | Butler et al. | 5/89 X |
| 3,940,808 | 3/1976 | Petrini | 5/89 |

FOREIGN PATENT DOCUMENTS

| | | | |
|---|---|---|---|
| 1,127,119 | 10/1956 | France | 5/86 |

*Primary Examiner*—Casmir A. Nunberg
*Attorney, Agent, or Firm*—Ladas, Parry, Von Gehr, Goldsmith & Deschamps

[57] ABSTRACT

In a lifting device for lifting patients there is provided a horizontal carrier bar having a patient supporting means. The carrier bar has one free end, the other end being connected by means of a lever to a shaft rotatably mounted in a support, said shaft being parallel to said carrier bar.

24 Claims, 6 Drawing Figures

LIFTING DEVICE

The present invention relates to a lifting device for lifting patients confined to their beds.

In order to facilitate the work of the medical staff in hospitals and similar institutions when lifting and transporting patients having reduced faculty of motion or being confined to their beds for other reasons, in connection with inter alia the transfer of the patient from one bed to another or from a stretcher to a bed, washing the patient and making the patient's bed, different lifting devices, here called patient lifters, have been developed.

The prior art patient lifters used in moving a patient are often stationary or attached to the ceiling and therefore have a very restricted range of operation. The lifting devices attached to the ceiling are unsatisfactory both in aesthetic and hygienic respects and make it impossible to redispose the room in question after their mounting.

Such a patient lifter attached to the ceiling comprises a rigid bar having a length corresponding to at least the normal length of a human being. The bar is adapted to be carried horizontally by means of two cables attached to each end of the bar. By means of intermediate pulleys the cables are connected to an electric hoist block or a telpher having two cable exits. As mentioned above, the telpher can be mounted to the ceiling but also on a wall. Along the rigid bar several displaceable yokes are arranged. The yokes have bands of plastics material intended to be arranged under the patient for supporting the same.

In utilizing these prior art patient lifters there is also a practical drawback. These prior art lifters have such a construction that the patient is lifted straight up from his bed which then has to be moved, whereupon a new bed, a stretcher or an operating table can be placed under the patient, and the patient is lowered onto the same. Another drawback in connection with the transfer of a patient from a bed to an operating table is that the operating table or the patient's bed must be transported over the hygienic zones which are provided to reduce the spreading of bacteria from the operating ward to the nursing ward and vice versa. When the operating table or the patient's bed is moved over these hygienic zones, uncontrolled amounts of bacteria preferably accumulated on the wheels of the operating table or the patient's bed can be brought into the operating ward or vice versa.

A suggestion for solving this problem is the arrangement of a hygienic sluice or a patient sluice, e.g. as a hatchway, in a wall between the operating ward and an adjacent bed-waiting-room. A known solution constitutes the provision of a patient lifter at the top portion of a closable opening in the wall, which lifter facilitates the turning in of a patient carried by the patient lifter through the opening around a vertical turning shaft. The patient lifter consists of a horizontal bar which is provided with yokes adapted to be fixed at their leg ends to a support surface on which the patient is supposed to rest. The bar is connected at a point along its extension to a swing arm perpendicular to the bar and movable in a vertical plane, said swing arm being coupled to the vertical turning shaft at its other end via a horizontal hinge, said shaft being arranged at the top portion of the opening. In order to facilitate lifting of the support surface and the patient lying thereon, a power means is disposed between the upper portion of said shaft and said arm. For the turning-in of the bar and the support surface carried by the yokes through an opening having a width which does not unnecessarily much exceed the length of the support surface, it is also required that the mounting point of said arm on the carrier bar has a vertical hinge.

A drawback of this patient lifter is thus the fact that the bar carrying the yokes in its turn is supported in only one mounting point and that the carrier arm is rotatably arranged in relation to the same, for which reasons the lifter is very sensitive to uneven loads as a result of the patient being placed with his centre of gravity displaced from a vertical line through said mounting point. The patient will thus easily assume a sloping position. The patient carried by the lifter, the yokes and the support means utilized must thus be so arranged in the lifter that the centre of gravity of the load is disposed essentially straight below said mounting point. This implies that several lifts and shifts of the patient as well as lifting bands, if any, may be required before the patient assumes a horizontal position at the final lift.

In order to eliminate these problems, patient lifters of this kind often have means cooperating with one or both ends of the bar carrying the yokes, which means is adapted to compensate for uneven loads. However, this compensation means makes the lifting devices very complicated.

In moving a patient by means of such a device from an adjacent room through the opening in the wall into the operating ward, the support surface, the patient, lying thereon, is first elevated subsequent to its attachment to the ends of the yokes. The swing arm is then turned around the vertical shaft and the support surface with the patient thereon is brought into the operating ward. An apparent drawback of this construction of a patient lifter is that the support surface, on which the patient lies, is brought into the operating ward. A better solution would be to use the lifting bands previously mentioned and to attach these to the leg ends of the yokes. Evidently, the lifting bands cannot accumulate as much bacteria as the whole support surface.

In addition to the drawback just mentioned, the known patient lifter for hygienic sluices has a large number of movable parts which make it complex and sensitive to defects. Also the sealing of the opening of the hygienic sluice by means of a shutter is difficult to achieve when the patient lifter is mounted to the upper portion of said opening.

In order to reduce the sealing difficulties, the patient lifter is preferably mounted on either side of the opening of the hygienic sluice. This non-symmetrical mounting means that the swing arm must have an unnecessarily large length in order to reach sufficiently far into the adjacent room when turning-in through the opening of the sluice.

Another known patient lifter often used in hygienic sluices has the commercial designation MAQUET. This patient lifter also comprises a transfer table to which the patient is manually lifted from his bed. The transfer table is supported by a horizontal support arm which is rotatably mounted at one of its ends in a horizontal plane at one side of the closable opening of said sluice between the operating ward and the adjacent bed-waiting-room. This kind of patient lifter has also the drawback that the patient must be manually lifted and that the transfer table, which is the top of the operating table, must be brought out of the operating ward to the bed-waiting-room which implies a risk of uncontrolled amounts of bacteria being brought along on the transfer table.

The mobile patient lifters supported by the floor, which are available on the market, all have the drawback that they require access to the long side of the patient's bed for their function which side is thereby blocked for the caretakers and the lifting procedure is thus aggravated.

Another disadvantage of the patient lifters previously known is that these are time consuming in their handling and often require at least two persons for lifting a patient from the patient's bed or the like to the lifter itself. Moreover, most of the known patient lifters are complex and thus difficult to handle.

The object of the present invention is to provide a lifting device or a patient lifter which eliminates the drawbacks connected to the patient lifters previously known, and without using any manual power, to facilitate the lifting of a patient, the transfer of the patient between two beds or from a bed to a stretcher or to an operating table in connection to a hygienic sluice without any large support surface being brought into the operating ward.

This object is achieved by means of a lifting device for lifting a patient confined to the bed which device is adapted for cooperation with the patient from the foot or head end, and comprises a horizontal carrier bar for arrangement along and over the patient, said carrier bar being provided with several yokes arranged to be coupled at their leg ends to supporting means insertable under the patient.

According to the invention the lifing device is characterized in that the carrier bar has a free end, its other end being connected by means of a lever to a horizontal shaft rotatably mounted in a support said shaft being coupled to a drive means for facilitating rotation of the shaft and thereby turning of the carrier bar along a circular curve.

The patient lifter according to the invention can preferably be provided with wheels carrying the support thereby facilitating the movement of the lifter. Moreover, the patient lifter can be mounted in a hygienic sluice for facilitating the transfer of a patient from his bed to an operating table on the other side of the sluice in a simple manner.

According to the invention the patient lifter can also be disposed on a transport carriage which is provided with a bed, so that a patient, when moved a large distance, is able to assume a comfortable and relaxed position during the transportation.

For the purpose of ellucidation, the invention will be described in greater detail in the following with reference to the accompanying drawings, wherein FIG. 1 shows an embodiment of a patient lifter according to the invention used for transferring a patient from his bed to an operating table.

The embodiments of the lifting device according to the invention and the associated drive means described below are only examples of illustration. Of course, a person skilled in the art may suggest several modifications and alterations.

Figure 1:
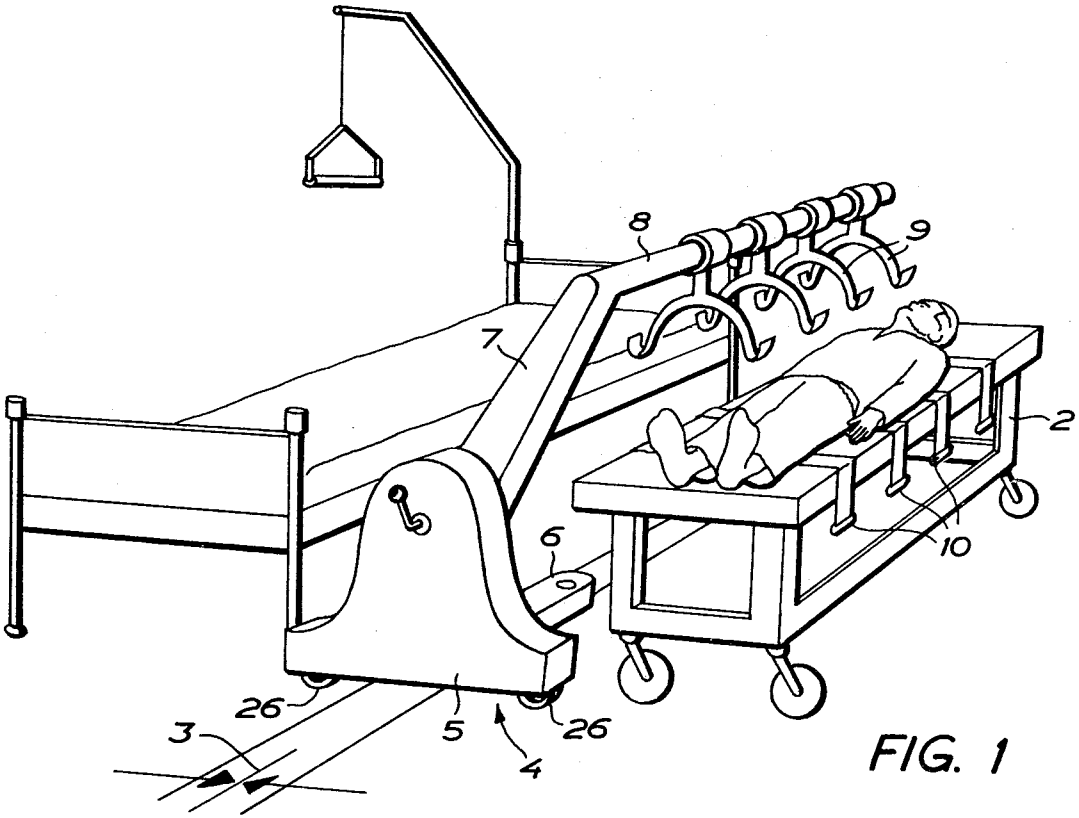

The lifting device according to the invention shown in FIG. 1 is used in connection with the transfer of a patient from his bed 1 to an operating table 2. The lifting device is arranged as a hygienic sluice between common hospital space and a hygienic zone which is marked by means of a line 3 painted on the floor. The lifting device is placed on the line 3 and makes it possible to transfer a patient to the operating table in the hygienic zone without the patient's bed, the operating table or any assisting person needing to cross the floor line 3.

The lifting device according to the invention comprises a support 4 standing on the floor and has a main body 5 from which a beam 6 extends for stabilizing the support. Both the main body 5 and the beam 6 can preferably be carried by lockable wheels 26 of a conventional type for facilitating movement of the lifting device.

A horizontal shaft 12 (see FIG. 4) is disposed in the upper part of the support 4, one end of the shaft being rigidly connected to a lever 7. The lever 7 is rigidly connected at its other end to a strong, horizontal carrier bar 8 having a length at least corresponding to the average patient length. On the carrier bar several yokes 9 are mounted which are displaceable along the bar and rotatable around the same, which yokes have leg ends turned upwards and adapted for coupling to a patient supporting means, such as lifting bands 10, which are disclosed lying under the patient. The yokes 9 are made of a material resistant to bending, such as steel or plastics, while the lifting bands preferably consist of plastics material. The lever 7 and the carrier bar 8 are preferably holed sections of steel or any other material resistant to bending.

Although the lever 7 is preferably perpendicular to the shaft 12 and the carrier bar 8, and thus pivotable in a vertical plane, it is realized that the lever 7 may be inclined to the shaft 12 and the carrier bar 8.

It is realized from the above that the carrier bar 8 is parallel with the shaft 12. On the support a hand crank 11 is shown for actuation of a drive means, in the main body 5 of the support for rotating the shaft 12 and hence movement of the carrier bar over a circular curve. The hand crank is also provided with a locking device (not shown) for locking the shaft 12 in an arbitrary position.

In utilizing the lifting device according to the invention for transferring a patient between two beds, or, as illustrated in FIG. 1, between a patient's bed to an operating table, the lifting bands 10 are first placed under the patient lying in his bed 1. The lever 7 of the lifting device is then swung in over the bed 1 so that the carrier bar 8 is brought into a position along the patient and centrally over him.

The lifting bands are connected at their ends to the associated leg ends of the yokes, whereupon the lever 7 is swung towards the operating table, by means of the drive means of the lifting device, placed beside the bed, the patient thereby being smoothly lowered onto the operating table. The lifting bands are then disconnected from the leg ends of the yokes and are preferably left under the patient for later use, whereupon the operating table can be moved to the place for the operation.

Figure 2:
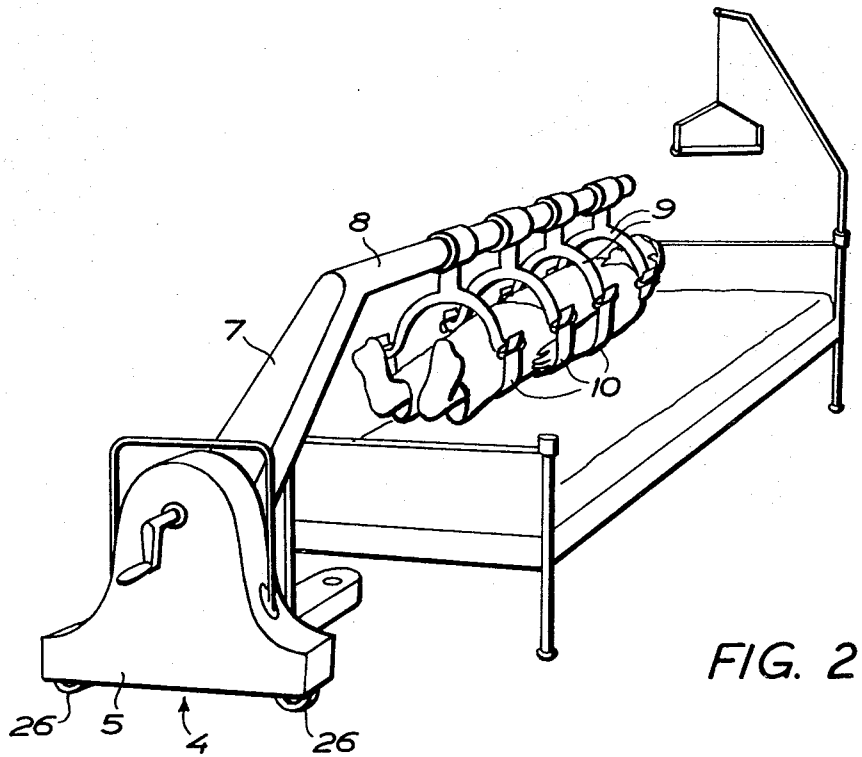
FIG. 2 shows the patient lifter according to FIG. 1 when used for lifting a patient above his bed.

FIG. 2 illustrates how the lifting device according to the invention is utilized for elevating a patient from his bed. In the same as previously described, the carrier bar 8 is brought in over the bed in that the lever 7 is swung to a suitable position. The lifting bands previously placed under the patient are connected at their ends to the associated leg ends of the yokes, whereupon the lever 7 is swung in the opposite direction elevating the patient. The patient can be elevated a short distance for salving of bedsores or other measures or be swung completely away from the bed which can thereby be easily prepared and made.

Figure 3:
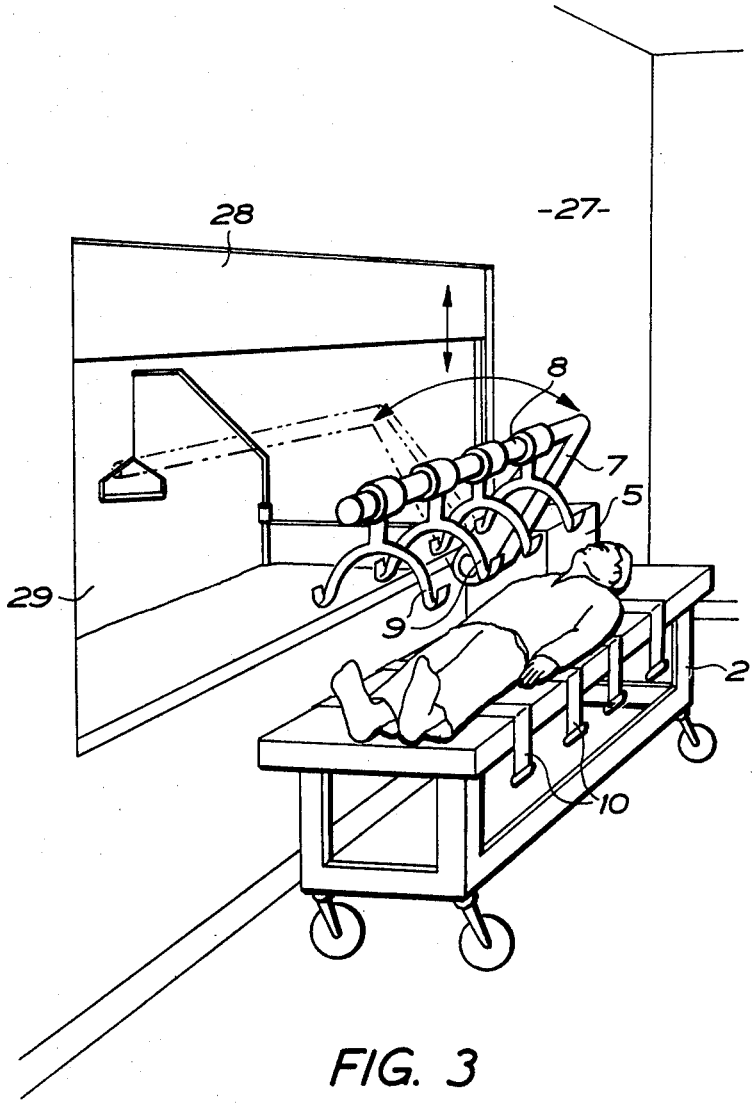
FIG. 3 shows a second embodiment of the patient lifter according to the invention mounted in a hygienic sluice for transferring a patient into an operating ward from an adjacent bed-waiting-room.

FIG. 3 shows a second embodiment of the lifting device according to the invention utilized in a hygienic sluice between an operating room and an adjacent bed-waiting-room. In the wall 27 between these spaces an opening 29 is made which is closable by means of a shutter 29. At one bottom side of the opening the lever 7 is mounted at one end rotatably movable around a horizontal shaft 12 so that the lever 7 with the carrier bar 8 fixed at its other end can be swung in through the opening. The support 4 of the lifting device is mounted on the wall 27 in a suitable way. Although the lifting device according to FIG. 3 is mounted on one side of the wall, it is preferred that the lifting device is mounted in one bottom corner of the opening. Since the main body 5 of the support 4 is attached on the wall the stabilizing beam 6 is not required and is removed, and so are the wheels adapted for the movement of the lifting device. When the opening of the patient sluice is closed by means of the shutter, the patient lifter is brought into such a position that the carrier bar 8 is inserted in one of the two spaces separated by the sluice.

In utilizing the lifting device in connection with the hygienic sluice the patient lying in his bed is first rolled to the closed opening. The bed is arranged parallel to the wall at a suitable distance therefrom. Simultaneously the operating table is arranged on the other side of the wall at a suitable distance therefrom and therealong. The shutter in the wall is opened and the carrier bar 8 is swung by means of lever 7 in over the patient into such a position that the leg ends of the yokes 9 can easily be coupled to the lifting bands 10 previously inserted under the patient. The patient is then elevated and transferred in an arcuate path through the opening 29 onto the operating table, whereupon the lifting bands are disconnected from the leg ends and the opening is closed by means of the shutter 28. It is quite obvious from what has been mentioned that a minimum number of objects and no object which is in contact with the floor have been brought into the operating ward together with the patient, only the lifting bands. Neither does any person enter the operating room who has not previously been there, for performing the transfer of the patient to the operating table. Moreover, only one person is required on each side of the sluice for facilitating the lifting of the patient. This is an important advantage in relation to the hygienic sluices previously known in which two or three persons are required on each side of the sluice for manually lifting the patient. Since there is generally some overpressure in the ventilation in the operating room in relation to the adjacent spaces the lifting device according to the invention facilitates a very effective sluicing system.

It appears that the patient lifter according to the invention, either movably or stationarily mounted, e.g. in a hygienic sluice, is arranged to cooperate with a patient from the foot or head end in lifting the same. In a mobile embodiment of the patient lifter according to the invention the support 4 is placed, close to the patient or his bed at any of the ends of the bed, whereupon the carrier bar 8 is brought in over the patient.

Figure 4:
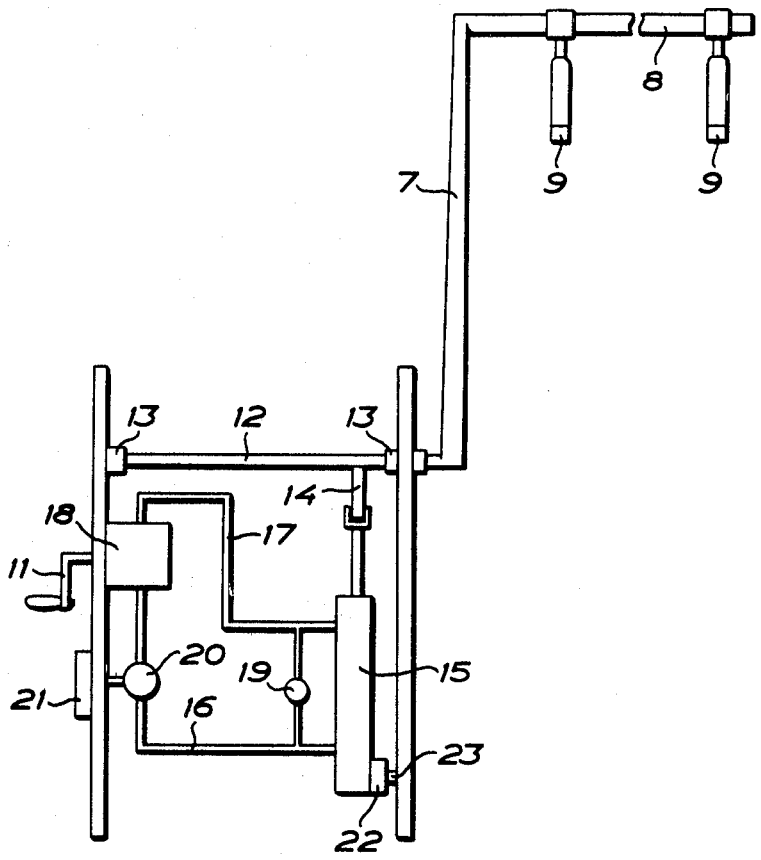
FIG. 4 is a diagrammatic view of a preferred embodiment of a hydraulic drive means for the patient lifter.

In FIG. 4 a preferred hydraulic drive means for actuating the lifting device according to the invention is illustrated in a side elevation view of the lifting device according to the invention. In the illustrated support 4, partially cut open, the lever 7 is disclosed attached at one end thereof to a horizontal shaft 12 which is rotatably mounted in adequate bearing means 13 which are secured in two opposite walls of the support. A minor arm 14 is rigidly connected to the shaft 12 and forms a right or larger angle to the lever 7. The minor arm 14 is provided with means for rotation of the shaft 12 for simultaneous turning of the lever 7.

Although several different mechanical, pneumatic or hydraulic systems can be utilized for operating the minor arm 14 and the lever 7, FIG. 4 discloses a preferred hydraulic system. This system comprises a double-acting hydraulic cylinder 15 which is connected by means of hydraulic conduits 16 and 17 at both its ends to a manually operable hydraulic pump 18. The hydraulic cylinder 15 which is rotatably mounted at one end around a pin 23 arranged between its mounting plate 22 and one wall of the support, has the free end of its piston rod rotatably connected to the end of the minor arm 14 facing away from the shaft. The hydraulic pump 18 which is adapted to be actuated by means of the hand crank 11 is preferably of such a kind or provided with such means that the hydraulic circuit is locked immediately when the crank is released, the piston rod of the hydraulic cylinder thereby being locked in its instant position and the lever 7 being maintained in the position obtained. In operation of the hydraulic pump for turning the lever 7 in one direction, one hydraulic conduit serves as a pressure conduit while the other serves as a return conduit. In opposite operation of the hydraulic pump for moving the lever in the opposite direction the hydraulic conduit, previously serving as a return conduit, will now function as a pressure conduit, while the pressure conduit will now serve as a return conduit. Between the two hydraulic conduits 16 and 17 a by-pass valve 19 is inserted which upon actuation shorts the hydraulic circuit and releases the lever 7 for facilitating simple manual adjustment of the bar 8 to an adequate height before elevation. Although a manually operable hydraulic pump 18 is preferred in most applications of the lifting device according to the invention, since the lifting device is completely independent of external power sources but man power and is very flexible, a hydraulic or electrical motor may be provided in the lifting devices according to the invention which are preferably stationarily mounted, e.g. in the lifting device shown in connection with the patient sluice according to FIG. 3, instead of the hand crank for driving the hydraulic pump.

In the hydraulic conduit 16 a pressure sensor 20, preferably of an electrical kind, is inserted and connected to a calibratable display means 21 in order to serve as a balance intended for measuring the weight of a patient elevated by means of the lifting device. The sensor 20 may also be mounted instead in the hydraulic conduit 17, if deemed suitable.

Figure 5:
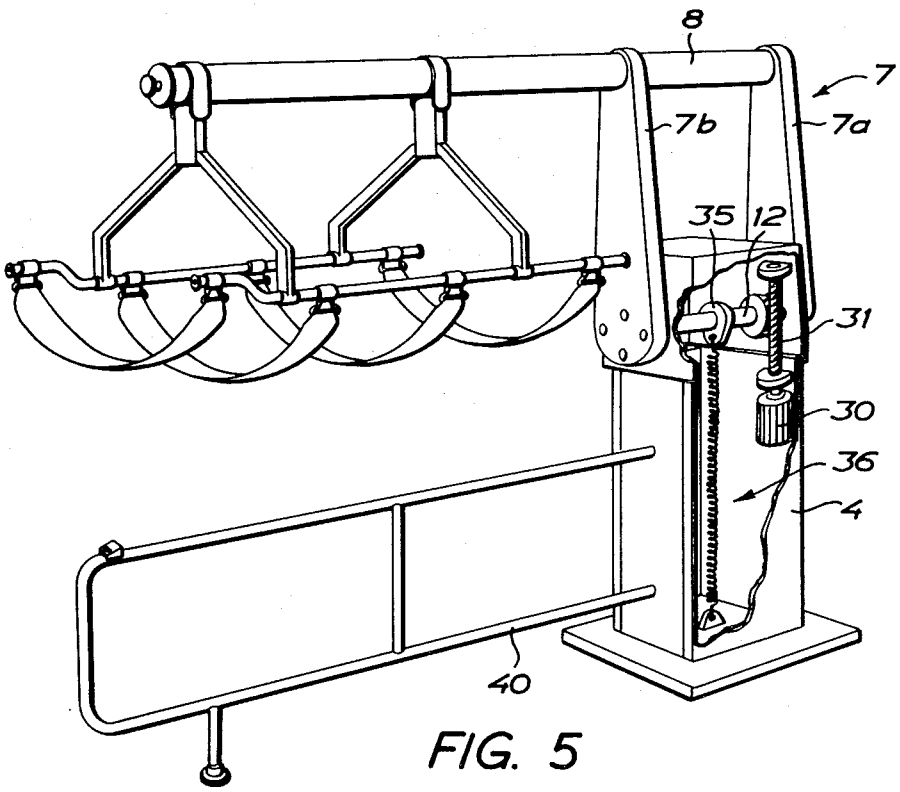
FIG. 5 shows a third embodiment of the patient lifter according to the invention, stationarily realized.

In FIG. 5 a further developed patient lifter according to the invention is disclosed. This embodiment is of the stationary type and can be mounted as a hygienic sluice between two areas having different hygienic requirements.

The units and parts in this embodiment of the patient lifter which correspond to identical units and parts in the embodiments previously described of the patient lifter are provided with the same reference numerals.

The patient lifter according to FIG. 5 comprises a support 4 made as a closed box, which support has a bottom plate stationarily fixed to the floor in a room or the like. A horizontal shaft 12 extends straight through the support 4 and is rotatably mounted at its ends in opposite walls of the support. A lever 7 rigidly connected to the shaft 12 comprises two spaced arms *7a* and *7b* attached to the shaft 12. At the free ends of the arms a carrier bar 8 is rigidly mounted and extends horizontally out from the support. A yoke device, not described in detail, for supporting a patient is supported by the carrier bar. As disclosed in FIG. 5 the arms *7a* and *7b* are preferably attached to the shaft at its ends.

The patient lifter is arranged for operation by means of an electric motor 30 over a gear means 31 which is coupled to the shaft 12. Although all kinds of gear means can be utilized, FIG. 5 discloses a preferred embodiment of a worm gear. A bracket 35 is rigidly fixed to the shaft 12. A spring means 36 comprises several pull springs operating in parallel (only one is shown) between the bracket 35 and ears 36 on the bottom plate of the support. The spring means 36 is biased to exert a minimum pull force when the carrier bar 8 takes its top position. This minimum pull force may be 750 N.

In utilizing the patient lifter the motor 30 is operated, the shaft 12 thereby being rotated by means of the worm gear, the lever 7 being turned and so the carrier bar 8 being brought downwards and outwards to one side or other of the support, after wish.

The carrier bar will be moved during its turning out under counter-action from the torque exerted by means of the spring means 36.

At the turning-out of the carrier bar 8 from its top position the spring means strives to return the carrier bar to its top position. Thus, when a patient is placed in the yoke device, the torque exerted by the spring means cooperates with the torque exerted by the motor for elevating or lifting the patient. As a result hereof, a relatively weak motor power is required for driving the patient lifter.

When the carrier bar with a patient in the yoke device has been elevated up to and beyond its top position its spring device guarantees that the lowering of the patient does not take place too rapidly, as the spring means counteracts the lowering procedure.

Moreover, the spring means provides increased security if the drive means should become defective and brake since said means substantially counteracts the torque exerted by the weight of the patient.

It should be understood that the lifting device illustrated in FIG. 5 can also be provided with a manually operable drive means, a hand crank being connected to the driving shaft of the gear means, or have a hydraulic drive means of the kind disclosed in FIG. 4.

Moreover, it is realized that the embodiment of the patient lifter illustrated in FIGS. 1 to 3, can have a lever which, like the lifting device according to FIG. 5, consists of two spaced arms, and have a drive means according to the lifting device in FIG. 5, either being operable by means of a motor or manually, by means of a hand crank.

The lifting device according to FIG. 5 is illustrated utilized in a hygienic sluice between areas having different hygienic requirements and is arranged for this purpose to cooperate with a barrier 40 which defines said two areas.

The barrier 40 which is disclosed attached to the support 4 of the lifting device but which can naturally be standing by itself, is arranged vertically below the carrier bar 8 of the lifting device when the bar assumes its top position. It can be seen that the lifting device facilitates the transfer of a patient from one area to the other, without any assisting person needing to pass the barrier.

Figure 6:
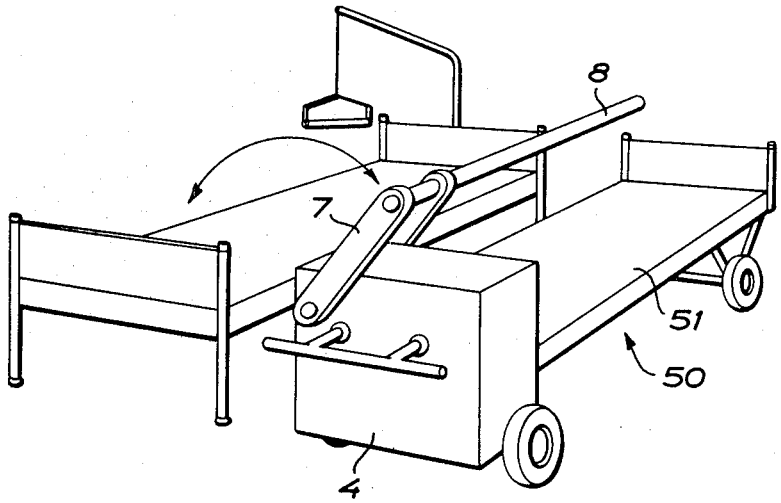
FIG. 6 shows a forth preferred embodiment of the patient lifter according to the invention, movably realized.

FIG. 6 illustrates a mobile embodiment of the lifting device according to the invention, this being arranged as a transport device 50 carried by wheels and provided with a bed 51 or the like. This embodiment of the lifting device is meant to be utilized for transporting a patient a large distance and facilitates the transfer of a patient by means of the lifting device from the patient's bed to the transport device bed where the patient can lie in a comfortable and relaxed position.

As can be seen in FIG. 6, the support 4 of the lifting device is mounted at one end of the bed 51 of the transport device. The support 4 has a shape adapted to the bed 51 but which is provided for the rest with a lever 7 and a carrier bar 8 of the same kind as the lifting device according to FIG. 5. The turning shaft of the lifting device is laterally positioned in relation to the symmetry plane of the bed in order to facilitate lowering of a patient onto the bed of the transport device. The drive means of the lifting device may be of any kind previously described but is preferably manually operable so that it is independent of external electric power sources. Moreover, the drive means of the lifting device can be either hydraulic, e.g. according to FIG. 4, or provided with a mechanical gear means according to FIG. 5.

Contrary to the lifting devices previously known the patient lifter according to the invention has the advantage of being positioned at the foot- or head end of a patient's bed. One of these ends are always free, apart from a possible visitor's chair, while at the long sides of the bed there are a patient table and often equipment for nursing the patient. Since the patient lifter according to the invention operates from one end of the bed none of the long sides of the bed is blocked and the medical staff can easily reach the patient also when the patient lifter is put in its place.

Another advantage of the patient lifter described is that it is totally insensitive to uneven loads because of its structure, for which reason the patient always will lie horizontally in an elevated position.

Moreover, the lifting device facilitates the lowering of a patient into a bath tub or the like as well as lowering a patient to a position in plane with the floor.

A further advantage of the patient lifter according to the invention is that it can easily be operated be one person only.

What I claim is:

1. A lifting device for lifting a patient confined to bed, which device is adapted for cooperation with the patient from the foot or head end of the patient without obstructing access to the patient from the other end or from either side, said device comprising a horizontal drive shaft, a lever having one end connected to the drive shaft, and a carrier bar for arrangement along and over the patient and disposed parallel to the drive shaft, the carrier bar having one end connected to the other end of the lever and its other end being free, and the device further comprising patient supporting means suspended from the carrier bar and having two support portions disposed at opposite sides respectively of the patient when the carrier bar is arranged along and over the patient, at least one elongate support member which is insertable under the patient and is connectable at its opposite ends to the support portions respectively, and drive means connected to the drive shaft to bring about rotation thereof, thereby to move said carrier bar along an arcuate path.

2. A device as claimed in claim 1, wherein said lever is disposed essentially in a vertical plane.

3. A device as claimed in claim 1, wherein said lever consists of two spaced lever elements fixed to said shaft.

4. A device as claimed in claim 1, comprising biased spring means arranged between a bracket on said shaft and said support, said spring means being arranged with minimum bias when said carrier bar occupies its top position.

5. A device as claimed in claim 1, wherein said support is carried by wheels.

6. A device as claimed in claim 1, wherein said drive means comprises a gear means, the driving shaft of which being driven by a motor.

7. A device as claimed in claim 1, wherein said drive means is hydraulic and comprises a double-acting hydraulic cylinder operable by means of a hydraulic pump, the piston rod of said cylinder being connected to said shaft for rotation thereof.

8. A device as claimed in claim 7, comprising a by-pass valve inserted between hydraulic conduits connecting the hydraulic cylinder and the hydraulic pump for releasing said shaft.

9. A device as claimed in claim 8, comprising pressure sensor means inserted in one of the hydraulic conduits and connected to a display means for indicating the weight of a patient carried by the lifting device.

10. A device as claimed in claim 7, wherein the hydraulic pump is manually operable.

11. A device as claimed in claim 1, wherein said barrier constitutes a part of a hygienic sluice including a closable opening in a wall between two spaces having different hygienic requirements, said support being arranged at the bottom portion of one side of said opening such that said lever is freely movable through said opening.

12. A device as claimed in claim 11, wherein said support is comprises of part of said wall or an element mounted on said wall.

13. A device as claimed in claim 1, wherein said drive means comprises a gear means, the driving shaft of which being driven by means of a motor.

14. A device as claimed in claim 1, wherein said drive means is hydraulic and comprises a double-acting hydraulic cylinder operable by means of a hydraulic pump, the piston rod of said cylinder being connected to said shaft for rotation thereof.

15. A device as claimed in claim 1, comprising a by-pass valve, inserted between hydraulic conduits connecting the hydraulic cylinder and the hydraulic pump for releasing said shaft.

16. A device as claimed in claim 1, wherein said drive means comprises a gear means, the driving shaft of which being manually operable.

17. A lifting device for lifting a patient confined to the bed, comprising a horizontal carrier bar for arrangement along and over the patient, said carrier bar having a patient supporting means hinged thereon and having one free end, its other being connected by means of a lever to a shaft rotatably mounted in a support mounted at one end of a bed embodied as a transport device, said shaft being parallel to said carrier bar and being coupled to a drive means for rotation of said shaft.

18. A device as claimed in claim 17, wherein said drive means comprises a gear means, the driving shaft of which being manually operable.

19. A device as claimed in claim 17, wherein said drive means is hydraulic and comprises a double-acting hydraulic cylinder operable by means of a hydraulic pump, the piston rod of said cylinder being connected to said shaft for rotation thereof.

20. A device as claimed in claim 19, comprising a by-pass valve, inserted between hydraulic conduits connecting the hydraulic cylinder and the hydraulic pump, for releasing said shaft.

21. A device as claimed in claim 19, wherein said hydraulic pump is manually operable.

22. A device as claimed in claim 1, wherein said patient supporting means comprise a plurality of yokes each having two leg ends disposed at opposite sides respectively of the patient when the carrier bar is arranged along and over the patient, each such leg end being provided with a support portion.

23. A device as claimed in claim 1, wherein said drive shaft is rotatably mounted in a support which is stationarily mounted in relation to a barrier for defining two spaces having different hygienic requirements, said carrier bar being pivotable from one side of the barrier to the other by rotation of the drive shaft.

24. A device as claimed in claim 13, wherein the gear means comprise a worm gear.

* * * * *